US010998115B2

(12) United States Patent
Choi

(10) Patent No.: US 10,998,115 B2
(45) Date of Patent: May 4, 2021

(54) INDUCTOR

(71) Applicant: SAMSUNG ELECTRO-MECHANICS CO., LTD., Seoul (KR)

(72) Inventor: Woon Chul Choi, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/822,174

(22) Filed: Mar. 18, 2020

(65) Prior Publication Data

US 2020/0219640 A1 Jul. 9, 2020

Related U.S. Application Data

(63) Continuation of application No. 15/675,316, filed on Aug. 11, 2017, now Pat. No. 10,636,554.

(30) Foreign Application Priority Data

Dec. 13, 2016 (KR) ..... 10-2016-0169878

(51) Int. Cl.

| | |
|---|---|
| ***H01F 5/00*** | (2006.01) |
| ***H01F 10/06*** | (2006.01) |
| ***H01F 5/04*** | (2006.01) |
| ***H01F 17/00*** | (2006.01) |
| ***H01F 17/04*** | (2006.01) |
| ***H01F 27/32*** | (2006.01) |

(52) U.S. Cl.

CPC ..... *H01F 5/003* (2013.01); *H01F 5/04* (2013.01); *H01F 10/06* (2013.01);

(Continued)

(58) Field of Classification Search

CPC . H01F 27/323; H01F 27/324; H01F 2017/048

(Continued)

(56) References Cited

U.S. PATENT DOCUMENTS

2014/0247101 A1* 9/2014 Cha ..... H01F 41/12 336/198
2015/0102889 A1* 4/2015 Choi ..... H01F 17/0013 336/200

(Continued)

FOREIGN PATENT DOCUMENTS

CN 104575935 A 4/2015
CN 104934187 A 9/2015

(Continued)

OTHER PUBLICATIONS

English translation of JP09252087 (Year: 1997).*

(Continued)

*Primary Examiner* — Ronald Hinson
(74) *Attorney, Agent, or Firm* — Morgan, Lewis & Bockius LLP

(57) ABSTRACT

An inductor includes a support member, a plurality of conductor patterns disposed on at least one surface of the support member and supported by the support member, and an insulating structure interposed between conductor patterns adjacent each other among the plurality of conductor patterns, the insulating structure including a first insulating layer and a second insulating layer disposed on the first insulating layer, the second insulating layer covering side and upper surfaces of the conductor patterns, the second insulating layer being continuously formed along the side and upper surfaces of the conductor pattern, depending on external shapes of the side and upper surfaces of the conductor pattern disposed below the second insulating layer.

14 Claims, 5 Drawing Sheets

(52) U.S. Cl.
CPC ..... *H01F 17/0013* (2013.01); *H01F 17/04* (2013.01); *H01F 27/323* (2013.01); *H01F 27/324* (2013.01); *H01F 2005/046* (2013.01); *H01F 2017/002* (2013.01); *H01F 2017/048* (2013.01)

(58) Field of Classification Search
USPC ..... 336/200
See application file for complete search history.

(56) References Cited

U.S. PATENT DOCUMENTS

| | | | | |
|---|---|---|---|---|
| 2015/0155093 | A1 | 6/2015 | Kim et al. | |
| 2015/0270053 | A1* | 9/2015 | Cha | C25D 5/10 336/192 |
| 2016/0336105 | A1 | 11/2016 | Choi et al. | |

FOREIGN PATENT DOCUMENTS

| | | | |
|---|---|---|---|
| CN | 106158242 | A | 11/2016 |
| JP | 109-252087 | A | 9/1997 |
| KR | 10-1999-0066108 | A | 8/1999 |
| KR | 10-2015-0065075 | A | 6/2015 |

OTHER PUBLICATIONS

Office Action issued in corresponding Chinese Patent Application No. 201711142879.3 dated Nov. 5, 2019, with English translation.
Notice of Allowance issued in corresponding U.S. Appl. No. 15/675,316 dated Jan. 16, 2020.
Final Office Action issued in corresponding U.S. Appl. No. 15/675,316 dated Oct. 17, 2019.
Office Action issued in corresponding U.S. Appl. No. 15/675,316 dated Apr. 4, 2019.

* cited by examiner

INDUCTOR

CROSS-REFERENCE TO RELATED APPLICATION(S)

This application is the continuation application of U.S. patent application Ser. No. 15/675,316, filed on Aug. 11, 2017, now U.S. Pat. No. 10,636,554, which claims the benefit of priority to Korean Patent Application No. 10-2016-0169878, filed on Dec. 13, 2016 with the Korean Intellectual Property Office, the disclosures of which are incorporated herein by reference in their entirety.

TECHNICAL FIELD

The present disclosure relates to an inductor and, more particularly, to a thin-film type power inductor advantageous for a small size and high inductance.

BACKGROUND

In accordance with the development of information technology (IT), miniaturization and thinness of an apparatus have been accelerated and desired, and market demand for a small and thin device has increased.

The present disclosure provides a power inductor including a substrate having a via hole so as to be suitable to meet the demand of this technical trend, and coils disposed on both surfaces of the substrate and electrically connected to each other through the via hole of the substrate, in order to provide an inductor having a uniform coil with a large aspect ratio. However, due to limitations of the manufacturing process, there is still a limitation in forming the uniform coil with a large aspect ratio.

SUMMARY

An aspect of the present disclosure may provide an inductor capable of having structural stability and reliability in an entire structure, while including a coil with a high aspect ratio.

According to an aspect of the present disclosure, an inductor may include: a support member; a plurality of conductor patterns disposed on at least one surface of the support member and supported by the support member; and an insulating structure interposed between conductor patterns adjacent each other among the plurality of conductor patterns, wherein the insulating structure includes a first insulating layer and a second insulating layer disposed on the first insulating layer to cover side and upper surfaces of the conductor patterns, the second insulating layer being continuously formed along the side and upper surfaces of the conductor pattern, depending on external shapes of the side and upper surfaces of the conductor pattern disposed below the second insulating layer.

BRIEF DESCRIPTION OF THE DRAWINGS

The above and other aspects, features, and advantages of the present disclosure will be more clearly understood from the following detailed description, taken in conjunction with the accompanying drawings, in which.

DETAILED DESCRIPTION

Hereinafter, exemplary embodiments of the present disclosure will be described in detail with reference to the accompanying drawings.

Hereinafter, a plurality of inductors according to exemplary embodiments of the present disclosure will be sequentially described, but are not necessarily limited thereto.

Figure 1:
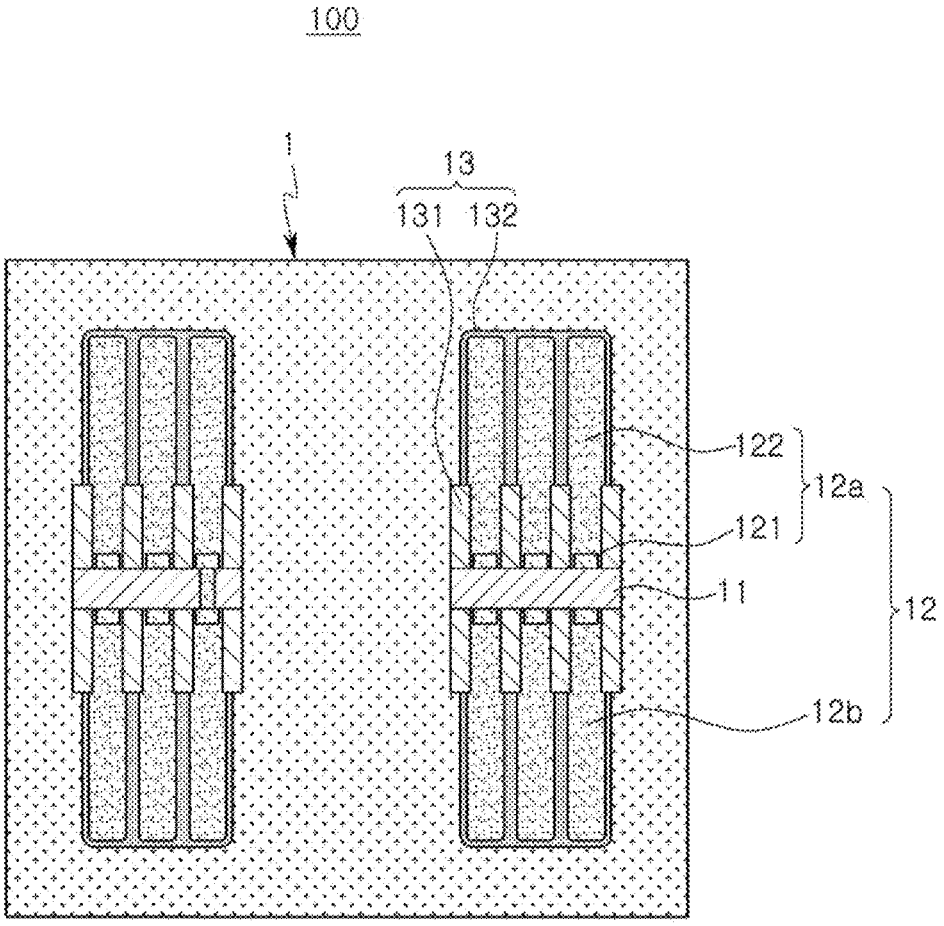
FIG. 1 is a cross-sectional view of an inductor according to exemplary embodiments of the present disclosure.

FIG. 1 is a cross-sectional view of an inductor according to exemplary embodiments of the present disclosure.

Referring to FIG. 1, the inductor 100 according to exemplary embodiment may include a body 1 and first and second external electrodes (not illustrated) disposed on an outer surface of the body.

First, the first and second external electrodes will be described. The first and second external electrodes may be formed of a metal having excellent electric conductivity. For example, the first and second external electrodes may be formed of one or more of nickel (Ni), copper (Cu), tin (Sn), silver (Ag), and the like, an alloy thereof, or the like. A method of forming the first and second external electrodes and specific shapes of the first and second external electrodes are not limited. For example, the first and second external electrodes may be formed in an letter C shape using a dipping method.

Next, the body 1 may form an exterior of the inductor, have upper and lower surfaces opposing each other in a thickness (T) direction, first and second end surfaces opposing each other in a length (L) direction, and first and second side surfaces opposing each other in a width (W) direction, and be substantially a hexahedron. However, the body 1 is not limited thereto. Here, a length of the body extended in the thickness direction will be referred to as a "thickness" or "height".

The body 1 may contain a magnetic material having magnetic properties. For example, the magnetic material in the body 1 may be ferrite or a material in which magnetic metal particles are filled in, or disposed in, a resin, wherein the magnetic metal particle may contain one or more selected from the group consisting of iron (Fe), silicon (Si), chromium (Cr), aluminum (Al) and nickel (Ni).

Meanwhile, a support member 11, a plurality of conductor patterns 12 supported by the support member 11, and an insulating structure 13 disposed between the conductor patterns 12 may be included in the body 1, together with the magnetic material.

First, the support member 11 will be described. The purpose of the support member 11 is to help form a thinner coil more easily. The support member may be an insulating substrate formed of an insulating resin. Here, as the insulating resin, a thermosetting resin such as an epoxy resin, a thermoplastic resin such as polyimide, a resin in which a reinforcement material, such as a glass fiber or an inorganic filler, may be impregnated to form a prepreg, an ajinomoto build-up film (ABF), FR-4, or the like, a bismaleimide triazine (BT) resin, a photo-imageable dielectric (PID) resin, or the like, may be used. When the glass fiber is contained in the support member, rigidity may be more excellent. A through hole H may be formed in a central portion of the support member, and the through hole may be filled with a magnetic material to thereby form a core part. Further, the support member may include a via (not illustrated) penetrating from an upper surface of the support member to a lower surface of the support member, and the via may be formed by processing a via hole in the support member and filling the via hole with a conductive material.

Next, the plurality of conductor patterns 12 supported by the support member will be described. The plurality of conductor patterns may be connected to each other to form a single coil, wherein the coil may have, for example, a spiral shape, but a specific shape of the coil is not limited.

The conductor pattern 12 may be formed on both upper and lower surfaces of the support member and be composed of upper and lower conductor patterns 12*a* and 12*b*. The upper and lower conductor patterns may be electrically connected to each other through the via included in the support member.

Each of the conductor patterns 12 may be composed of a plurality of plating layers. First, as illustrated in FIG. 1, each of the conductor patterns 12 may be composed of first and second conductor layers 121 and 122.

The first conductor layer 121 may be formed of a seed layer, and the seed layer may be disposed to contact the support member 11. In detail, the seed layer may be formed by performing an electroless plating method, a sputtering method, or the like, on the support member, and performing the etching. The first conductor layer may be formed of an isotropic plating layer, of which a degree of growth of the conductor pattern in the width direction and a degree of growth thereof in the thickness direction are almost equal to each other. A height of the first conductor layer may be about 10 μm to 30 μm, but is not limited thereto. The height of the first conductor layer may be appropriately determined by those skilled in the art in consideration of a total size of the inductor, inductance to be required, and the like, and the necessity for increasing the height of the first conductor layer by a large amount is low, considering that the first conductor layer is formed of the isotropic plating layer.

Next, the second conductor layer 122 may be formed by performing electroplating on the first conductor layer, using the first conductor layer as the seed layer. Since the second conductor layer is formed to fill a space in an insulating structure, to be described below, an inner wall of the insulating structure may contact a side surface of the second conductor layer. The second conductor layer may be formed of an anisotropic plating layer, of which a degree of growth of the conductor pattern in the width direction is larger than a degree of growth thereof in the thickness direction. Although a case in which the second conductor layer is formed of a single layer is illustrated in FIG. 1, the second conductor layer may also be formed of an anisotropic plating layer including a plurality of layers.

A thickness of the second conductor layer may be about 100 μm to 300 μm, but is not limited thereto. Since the thickness of the second conductor layer is substantially equal to a final thickness of the conductor pattern of the inductor, in order to form a conductor pattern having an aspect ratio (AR) of 3.0 or more in the second conductor layer, growth of the conductor pattern in the thickness direction may be promoted.

Meanwhile, the insulating structure 13 may be disposed in a space in which the conductor patterns 12 are spaced apart from each other. The insulating structure 13 may be disposed in a shape corresponding to a shape of the coil formed by the conductor pattern on the support member. The insulating structure 13 may serve to prevent a short-circuit between conductor patterns adjacent each other, and to prevent contact between magnetic materials adjacent the coil in the inductor.

The insulating structure 13 may include a first insulating layer 131 and a second insulating layer 132 disposed on the first insulating layer 131. The first and second insulating layers may have different shapes from each other, which will be described below, in detail.

First, at the time of cutting the insulating structure to be in parallel with the thickness direction, a cross section of the first insulating layer 131 may have a rectangular shape. A length of the first insulating layer in the length direction of the inductor (the length may be referred to as a "width" of the first insulating layer) may be about 10 μm to 30 μm, but is not limited thereto.

The first insulating layer 131 may contain an epoxy-based compound. For example, the first insulating layer may contain a photosensitive material, which is a permanent type photosensitive insulating material containing a bisphenol based epoxy resin as a main ingredient.

The first insulating layer 131 may be formed of a single layer, as illustrated in FIG. 1. Although not illustrated, the first insulating layer 131 may be composed of a first insulating layer wall disposed to be adjacent the support member, and a second insulating layer wall disposed on the first insulating layer wall. When the first insulating layer is formed of a double layer, the first insulating layer wall may contain a photo-imageable dielectric (PID) material capable of being stripped by a stripping solution. For example, the first insulating layer wall may contain a photosensitive material containing a cyclic ketone compound and an ether compound having a hydroxyl group as main ingredients, wherein the cyclic ketone compound may be, for example, cyclopentanone, or the like, and the ether compound having a hydroxyl group may be, for example, polypropylene glycol monomethyl ether, or the like, but the cyclic ketone compound and the ether compound are not limited thereto. Any photosensitive material may be used, as long as it may be stripped easily by the stripping solution. The second insulating layer wall may contain a permanent type photosensitive insulating material unlike the first insulating layer wall.

A sequence of patterning and disposing the first insulating layer 131 on the support member is not particularly limited, but the first insulating layer is patterned and disposed after formation of the first conductor layer, among the conductor patterns, is completed. Therefore, the first conductor layer may be positioned in an open space between the first insulating layers 131 in a state in which the first insulating layers 131 are spaced apart from each other on the support member at a predetermined interval on the support member.

Unlike an upper surface of the first insulating layer 131 contacting a second insulating layer 132, to be described below, a side surface of the first insulating layer may contact a side surface of a conductor pattern 12 adjacent thereto. A shape of the side surface of the first insulating layer may be substantially flat, as illustrated in FIG. 1, but the first insulating layer may also have a predetermined surface roughness and a structure in which troughs and crests are alternately positioned. In this case, adhesive strength with the conductor pattern may be improved.

A thickness of the first insulating layer is not particularly limited, but the first insulating layer may be formed to be positioned higher than an upper surface of the first conductor layer in the conductor pattern adjacent thereto. Further, the first insulating layer may have a thickness equal to or thicker than ⅓ of a thickness of the conductor pattern contacting the first insulating layer.

When the first insulating layer has a thickness such that the first insulating layer is positioned lower than the upper surface of the first conductor layer adjacent thereto, it may be difficult to completely remove a void (a state in which the insulating layer is not suitably filled) between the conductor patterns adjacent thereto, and the thinner the thickness of the first insulating layer, the higher the possibility that a pattern bending phenomenon of the anisotropic plating layer in the conductor pattern, or thickness distribution between the conductor patterns, will be increased. Further, the first insulating layer may have a thickness thicker than or equal to ⅓ of the thickness of the conductor pattern contacting the first insulating layer. Experimentally it has been found, in this case, that a risk of generation of the void between the respective conductor patterns may be substantially and completely removed, regardless of the AR of the coil.

Meanwhile, the first insulating layer may be formed to be positioned higher than an upper surface of the first conductor layer in the conductor pattern adjacent thereto and, at the same time, the first insulating layer may have a thickness equal to or thinner than 9/10 of the thickness of the conductor pattern contacting the first insulating layer. This means that the thickness of the first insulating layer may not exceed 90% of the thickness of the conductor pattern adjacent thereto. When the thickness of the first insulating layer exceeds 90% of the thickness of the conductor pattern adjacent thereto, while the conductor pattern is formed in the space between the first insulating layers by the electroplating method, bending or collapse of the first insulating layer supported by the support member, or the like, may occur, such that it is structurally difficult to secure reliability.

Next, the second insulating layer 132 may be disposed on the upper surface of the first insulating layer to cover the side and supper surfaces of the conductor pattern disposed below the second insulating layer 132.

Since the second insulating layer 132 is disposed to enclose the side and supper surfaces of the conductor pattern disposed below the second insulating layer 132, the second insulating layer may be formed after formation of the conductor pattern is completed.

As is clearly illustrated in FIG. 1, the second insulating layer may be continuously formed along the side and upper surfaces of the conductor pattern, depending on external shapes of the side and upper shapes of the conductor pattern. Structurally, when the side surface of the conductor pattern contacts the insulating structure adjacent thereto, a side surface of a lower portion of the conductor pattern may contact the first insulating layer, but a side surface of an upper portion of the conductor pattern may contact the second insulating layer.

The second insulating layer may be formed to have an entirely uniform thickness, the thickness of the second insulating layer being about 1 μm to 3 μm. In a case in which the thickness of the second insulating layer is thinner than 1 μm, while the magnetic material is filled or stacked on the insulated coil and then compressed or cured, the second insulating layer may be broken, such that a waveform defect due to a contact between the magnetic material and the conductor pattern may occur, and, in a case in which the thickness of the second insulating layer is thicker than 3 μm, an spare space in which the magnetic material may be disposed may not be sufficient, such that there may be a limitation in increasing inductance.

Further, a thickness deviation between a minimum thickness and a maximum thickness of the second insulating layer may be 1 μm or less, and, in a case in which the thickness deviation is greater than 1 μm in a specific region, growth of the second insulating layer may occur excessively or a portion that is not completely insulated may be present, which may have a negative influence on improving inductance, or cause a waveform defect.

A method of forming the second insulating layer is not particularly limited as long as the second insulating layer may be uniformly disposed in accordance with the external shapes of the conductor pattern insulated by the second insulating layer. For example, the second insulating layer may be formed by a chemical vapor deposition (CVD) method.

Any material may be used in the second insulating layer as long as it may form a uniform insulating film formed of a polymer. Examples of the material of the second insulating layer may include poly(p-xylylene), an epoxy resin, a polyimide resin, a phenoxy resin, a polysulfone resin, and a polycarbonate resin, or a resin of a perylene based compound. In particular, the second insulating layer may contain the perylene based compound, and by having this compound contained in the second insulating layer, a uniform and stable insulating layer may be implemented by the chemical vapor deposition method.

Figure 2:
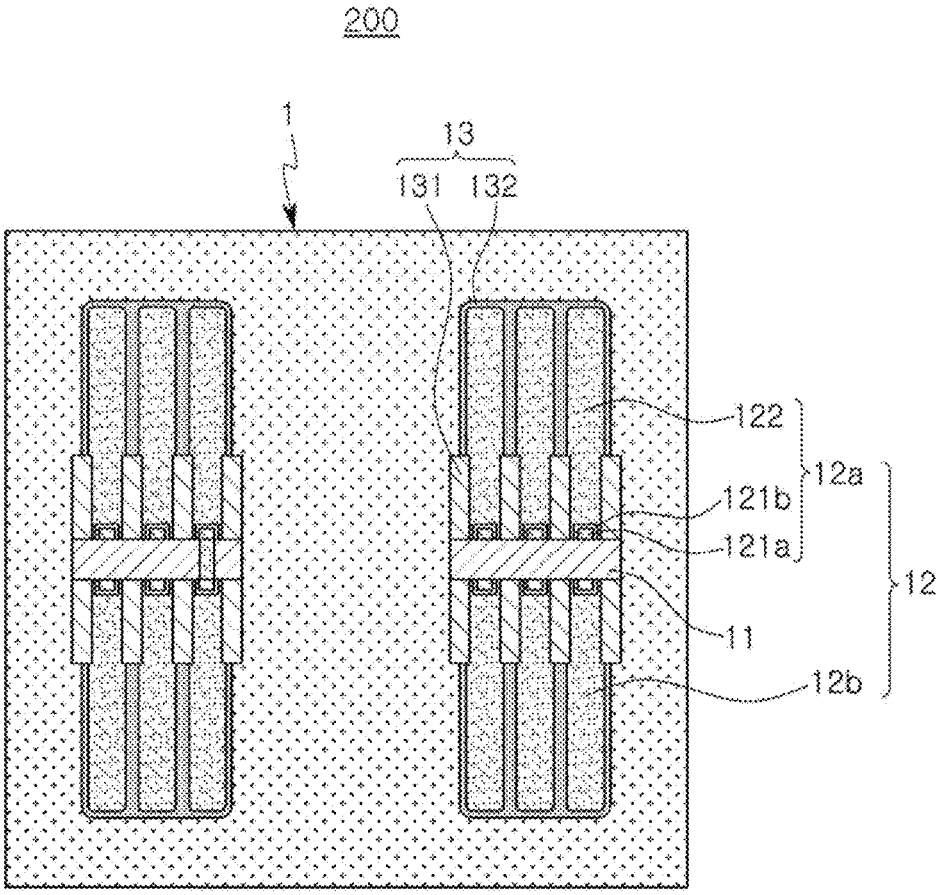
FIG. 2 is a cross-sectional view of an inductor according to exemplary embodiments of the present disclosure.

Next, FIG. 2 is a cross-sectional view of an inductor 200 according to exemplary embodiments of the present disclosure. Comparing the inductor 200 of FIG. 2 with the inductor of FIG. 1, a structure of each of the conductor patterns is different. For convenience of explanation, an overlapping description of the same components in the inductor of FIG. 2 as of those in the inductor of FIG. 1 will be omitted, and the same components will be denoted by the same reference numerals.

Referring to FIG. 2, a first conductor layer 121 may be composed of a plurality of layers, that is, a first inner conductor layer 121*a* and a first outer conductor layer 121*b*. Both the first inner and outer conductor layers may be formed of isotropic plating layers, and plating growth rates thereof in the width and height directions may be almost equal to each other.

The first inner plating layer may serve substantially as a seed layer of each of the conductor patterns, and the first outer plating layer 121*b*, as the isotropic plating layer, and a second plating layer 122, as an anisotropic plating layer, may be disposed on the seed layer.

In this case, the seed layer having a wider cross-sectional area than that of the seed layer of FIG. 1 may be secured, such that at the time of forming the anisotropic plating layer on the seed layer, the AR of the coil may be further increased.

Figure 3:
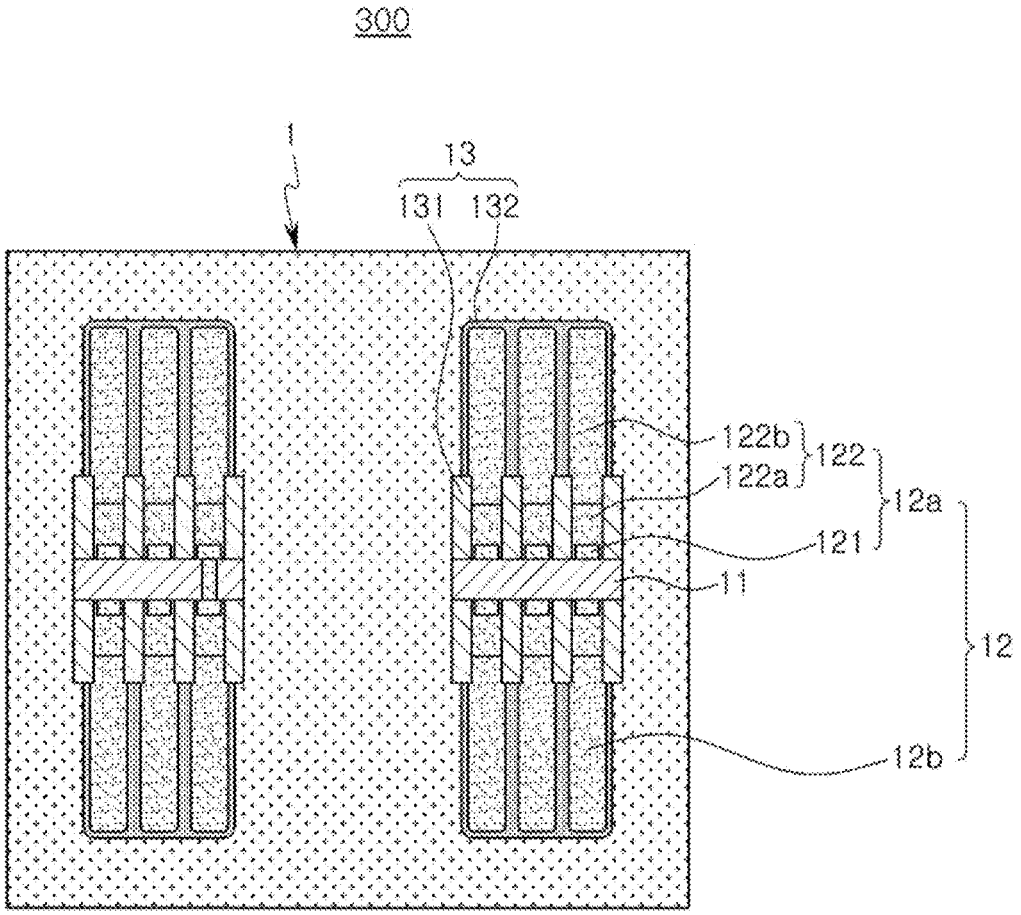
FIG. 3 is a cross-sectional view of an inductor according to exemplary embodiments of the present disclosure.

Next, FIG. 3 is a cross-sectional view of an inductor 300 according to exemplary embodiments of the present disclosure. Comparing the inductor 300 of FIG. 3 with the inductor of FIG. 1, a structure of each of the conductor patterns is different. For convenience of explanation, an overlapping description of the same components in the inductor of FIG. 3 as of those in the inductor of FIG. 1 will be omitted, and the same components will be denoted by the same reference numerals.

Referring to FIG. 3, a case in which the second conductor layer of FIG. 1 is composed of a plurality of layers is illustrated. First, a primary second conductor layer 122*a* is formed up to a height lower than a formation height of a first insulating layer in an insulating structure contacting a side surface of the second conductor layer, and a secondary second conductor layer 122*b* is formed thereon, again. In this case, a specific combination of shapes of the plating layers is not limited. For example, the primary second conductor layer 122*a* may be formed of an isotropic plating layer similar to that of the first conductor layer 121. However, the secondary second conductor layer 122*b* may also be formed of an anisotropic plating layer, or the like. The combination may be appropriately selected by those skilled in the art in consideration of working conditions or characteristics to be required. When the second conductor layer is composed of the plurality of layers, a boundary line between the plurality of plating layers, such as the primary second conductor layer, the secondary second conductor layer, or the like, included in the second conductor layer may be observed through a scanning electron microscope (SEM), a transmission electron microscope (TEM), or the like.

Figure 4:
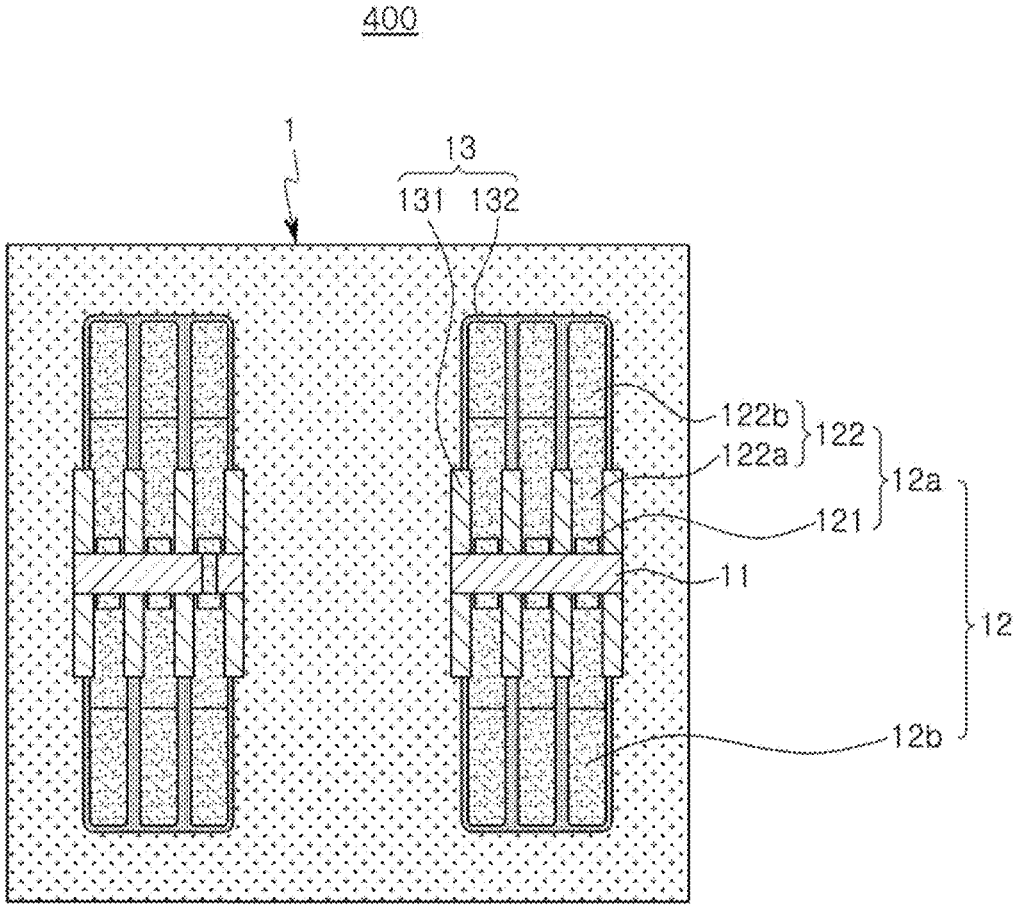
FIG. 4 is a cross-sectional view of an inductor according to exemplary embodiments of the present disclosure.

Next, FIG. 4 is a cross-sectional view of an inductor 400 according to exemplary embodiments of the present disclosure. The inductor of FIG. 4 is different from the inductor of FIG. 3 in that an upper surface of a primary second conductor layer 122*a* is positioned to be higher than a first insulating layer 131 in an insulating structure 13. The reason for this is that the primary second conductor layer is formed of an anisotropic plating layer, and this anisotropic plating layer may have a height such that a short-circuit does not occur between anisotropic plating layers adjacent each other. Meanwhile, although not illustrated, in order to form the primary second conductor layer 122*a*, for example, a separate support insulating layer having a structure in which the support insulating layer has substantially the same shape as that of the first insulating layer, but a width narrower than that of the first insulating layer, may be additionally disposed, and then a primary second plating layer may be plated so that a side surface of the support insulating layer contacts aside surface of the primary second conductor layer. Thereafter, the support insulating layer may be selectively removed. In this case, a method of selectively removing the support insulating layer is not limited. For example, a $CO_2$ laser may be used, or a stripping solution capable of selectively stripping the support insulating layer may be used.

With the inductor illustrated in FIG. 3 or 4, an AR of the coil may be effectively increased, and generation of voids may be completely prevented.

As described above, since the inductors according to various exemplary embodiments in the present disclosure include the insulating structure having a uniform and thin thickness, the coil having a high aspect ratio (AR,) as compared to an inductor according to the related art, may be formed. In particular, since the second insulating layer in the insulating structure is formed at a thin thickness, in accordance with the shape of the coil pattern, a space in which the magnetic material is contained in the body may be secured to be as wide as possible. This will be described in detail with reference to FIG. 5.

Figure 5:
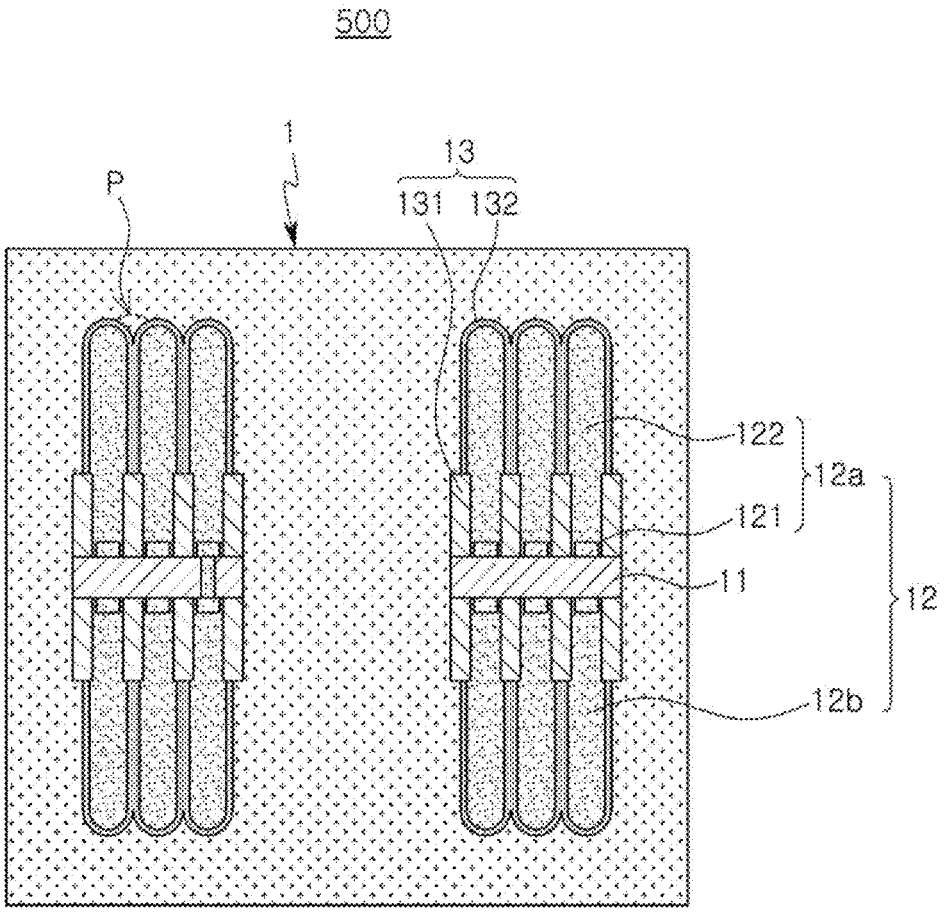
FIG. 5 is a cross-sectional view of an inductor according to exemplary embodiments of the present disclosure.

FIG. 5 is a cross-sectional view of an inductor 500 according to exemplary embodiments of the present disclosure, as a modified example of the inductor of FIG. 1. For convenience of explanation, overlapping descriptions of the same components in the inductor of FIG. 5 as of those in the inductor of FIG. 1 will be omitted, and the same components as those in the inductor of FIG. 1 will be denoted by the same reference numerals as in FIG. 1.

Referring to FIG. 5, in view of a spacing distance between conductor patterns adjacent each other in the inductor 500, a spacing distance in an upper region of the conductor pattern is greater than that in a lower region of the conductor pattern. Of course, a spacing distance between the conductor patterns in a lowermost region of the conductor pattern, that is, a contact region of the conductor pattern with the support member, may be substantially equal to a width of the first insulating layer. However, the spacing distance between the conductor patterns in the upper region of the conductor pattern, and particularly in a region in which an upper surface of the conductor pattern is disposed, may be greater than a spaced distance between second insulating layers disposed thereon. This is basically due to a structural difference of the conductor pattern. In particular, the second insulating layer, disposed on an outer surface of the conductor pattern, along the edge of the conductor pattern, may be sufficiently thin that a spare space P may be secured between second insulating layers adjacent each other.

A magnetic material may be additionally filled in the spare space P and, as a result, permeability and inductance of the inductor may be increased.

As set forth above, according to exemplary embodiments of the present disclosure, the inductor capable of preventing a short-circuit defect from occurring, due to connection between the coil patterns adjacent each other, while preventing a void from being generated in a space between the coil patterns adjacent each other at the time of configuring the coil, and having a high aspect ratio, is provided.

While exemplary embodiments have been shown and described above, it will be apparent to those skilled in the art that modifications and variations could be made without departing from the scope of the present disclosure, as defined by the appended claims.

What is claimed is:

1. An inductor comprising:

a support member;

a plurality of conductor patterns disposed on at least one surface of the support member and supported by the support member; and an insulating structure interposed between conductor patterns adjacent each other among the plurality of conductor patterns, the insulating structure including a first insulating layer and a second insulating layer disposed on the first insulating layer, the second insulating layer covering side and upper surfaces of the conductor patterns, the second insulating layer being continuously formed along the side and upper surfaces of the conductor patterns, depending on external shapes of the side and upper surfaces of the conductor patterns disposed below the second insulating layer, wherein a width of an interface between the first insulating layer and the support member is wider than a width of an interface between the first insulating layer and the second insulating layer, and a thickness of an area of the second insulating layer covering the upper surfaces of the conductor patterns is less than a thickness of at least one area of the first insulating layer, interposed between said conductor patterns adjacent each other, covering the side surfaces of the conductor patterns.

2. The inductor of claim 1, wherein an average width of the first insulating layer is wider than that of the second insulating layer.

3. The inductor of claim 1, wherein the first insulating layer contains an epoxy based resin, and the second insulating layer contains a perylene based resin.

4. The inductor of claim 1, wherein the conductor patterns have an aspect ratio (AR) of 3.0 or more.

5. The inductor of claim 1, wherein an average thickness of the conductor patterns ranges from 100 μm to 300 μm, inclusive.

6. The inductor of claim 1, wherein at least one of the conductor patterns includes at least three conductor layers comprising first to third conductor layers, the first conductor layer being a seed layer contacting the at least one surface of the support member and formed of an isotropic plating layer, the second conductor layer enclosing an outer surface of the first conductor layer and formed of an anisotropic plating layer, the third conductor layer disposed on the second conductor layer and formed of an anisotropic plating layer, and wherein the second insulating layer contacts only an outer surface of the third conductor layer or simultaneously contacts external surfaces of the second and third conductor layers.

7. The inductor of claim 1, wherein a space between portions of the first insulating layer adjacent each other is filled with a portion of the conductor patterns.

8. The inductor of claim 1, wherein the support member includes a via penetrating from the at least one surface of the support member to another surface thereof, and the via electrically connects the conductor patterns disposed on the at least one surface of the support member and a conductor pattern disposed on the another surface thereof to each other.

9. The inductor of claim 1, wherein the thickness of the area of the second insulating layer covering the upper surfaces of the conductor patterns is less than a thickness of at least one area of the second insulating layer, interposed between said conductor patterns adjacent each other, covering the side surfaces of the conductor patterns.

10. The inductor of claim 1, wherein the conductor patterns include first and second conductor layers, and the first conductor layer is a seed layer contacting the at least one surface of the support member and is formed of an isotropic plating layer.

11. The inductor of claim 10, wherein an upper surface of the first conductor layer is positioned lower than an upper surface of the first insulating layer.

12. The inductor of claim 10, wherein the second conductor layer is disposed on an upper surface of the first conductor layer and formed of an anisotropic plating layer.

13. The inductor of claim 1, wherein a distance from the at least one surface of the support member to an upper surface of the first insulating layer supported by the support member is greater than or equal to ⅓ of a thickness of the conductor patterns contacting the first insulating layer.

14. The inductor of claim 13, wherein the distance from the at least one surface of the support member to the upper surface of the first insulating layer supported by the support member is less than or equal to 9/10 of the thickness of the conductor patterns contacting the first insulating layer.

* * * * *